US005645490A

United States Patent [19]

Lodrick

[11] Patent Number: 5,645,490

[45] Date of Patent: Jul. 8, 1997

[54] ADJUSTABLE CUE BRIDGE

[76] Inventor: Lester B. Lodrick, 603 E. Meyers, Hazel Park, Mich. 48030

[21] Appl. No.: 575,552

[22] Filed: Dec. 20, 1995

[51] Int. Cl.[6] ..... A65D 15/00

[52] U.S. Cl. ..... 473/42

[58] Field of Search ..... 473/42, 43

[56] References Cited

U.S. PATENT DOCUMENTS

| | | | |
|---|---|---|---|
| 196,568 | 10/1877 | Doughty . | |
| 199,105 | 1/1878 | Prentice . | |
| 215,848 | 5/1879 | Watson | 473/42 |
| 968,187 | 8/1910 | McIntire | 473/42 |
| 2,817,525 | 12/1957 | Niemann . | |
| 3,576,324 | 4/1971 | Lareau . | |
| 3,724,849 | 4/1973 | Pierce | 473/42 |
| 4,953,860 | 9/1990 | Ames . | |
| 5,295,682 | 3/1994 | Leonard . | |

FOREIGN PATENT DOCUMENTS

| | | | |
|---|---|---|---|
| 3984 | of 1913 | United Kingdom | 473/42 |
| 19470 | of 1913 | United Kingdom | 473/42 |

*Primary Examiner*—Mark S. Graham
*Attorney, Agent, or Firm*—Young & Basile, PC

[57] ABSTRACT

An adjustable cue bridge includes a plurality of rotatable members, at least one of which has at least one cue receiving notch. The members are mounted about a body and are rotatable between a first overlapping, compact storage position to at least one deployed position in which the cue receiving notch in at least one of the plurality of members is positioned for supporting a cue. Detents formed in certain of the rotatable members are engaged by a detent paw in another of the rotatable members to releasibly lock the rotatable members in any of the storage and deployed positions.

16 Claims, 4 Drawing Sheets

ADJUSTABLE CUE BRIDGE

BACKGROUND OF THE INVENTION

1. Field of the Invention

The present invention relates, in general, to bridges attachable to pool cues.

2. Description of the Art

In the games of pool and billiards, a cue stick is used by players to strike and propel a cue ball toward other balls on the pool or billiards table. The player uses one hand to support the cue stick adjacent the tip of the cue stick when aligning the cue stick with the cue ball to propel the cue ball in a desired direction.

Frequently, the close proximity of other balls to the cue ball or the long distance of the cue ball from a side rail of a pool or billiards table makes it difficult for the player to place his or her hand in a stable position to support the cue stick.

In these situations, a bridge typically mounted on the tip end of another cue stick is employed to support the cue stick to enable the player to reach and strike the cue ball.

The most common type of bridge is a rigid one-piece member having at least one and usually a plurality of spaced notches formed on the top and side edges. Each notch forms a support surface which allows sliding movement of the cue stick through the bridge while the bridge supports the cue stick. The generally rectangular form of such a bridge coupled with notches formed in various side edges enables the bridge to be oriented horizontally or vertically to enable a player to selectively support the tip of a cue stick at different heights above the surface of the table.

In order to provide greater versatility in supporting the tip of a cue stick, bridges have also been formed with movable components which enable the height and/or lateral position of the cue stick supporting notches to be selectively varied. For example, in U.S. Pat. Nos. 196,568 and 2,817,525, the bridge includes a rigid bottom piece and a movable upper piece which is slidably and angularly positionable with respect to the bottom piece. A screw fastener is employed to fix the upper piece in the desired position with respect to the lower piece. Similarly, U.S. Pat. No. 3,576,324 discloses an adjustable cue bridge in which a planar strip member is movably mounted in a rigid one-piece bridge member. Interconnecting lugs and recesses enable the planar strip to be selectively extended from either side of the bridge member. U.S. Pat. No. 199,105 discloses a bridge in which a irregularly shaped member having a plurality of circumferentially spaced cue supporting notches is rotatably mounted on a rigid base piece. The rotatable member is rotated to the desired position and fixed in position by a threaded screw which extends through the rotatable member and the base into the supporting cue stick. The rotatable member has an irregular shape thereby enabling the cue supporting notches therein to be positioned above the base piece at variably selectable heights.

While these previously devised cue bridges provide flexibility in selectively positioning a cue supporting notch at a desired height or lateral position above the table, most suffer from the disadvantage that the adjustable component of such bridges must be fixed in the desired position by means of a threaded fastener thereby requiring a screwdriver or other tool to rearrange the components of the adjustable bridge. Further, each of the adjustable bridges as well as the conventional one-piece bridge has an overall size which makes it inconvenient to easily store the bridge in the pocket of a user when not in use.

Thus, it would be desirable to provide an adjustable cue bridge for removable attachment to a cue stick which is collapsible to a small compact size for storage while still being expandable into different configurations for use in various playing conditions.

SUMMARY OF THE INVENTION

The present invention is an adjustable cue bridge which is removably attachable to the tip end of a elongated tubular member, such as a cue stick.

The adjustable cue bridge of the present invention includes a body having receiver means carried therewith for receiving a tip end of a tubular member, such as a cue stick. A plurality of members are rotatably carried on the body, with at least one of the members having at least one cue receiving notch formed therein.

The plurality of members preferably include a first member rotatably mounted on the body therein. A second member is also rotatably carried on the body. The at least one cue receiving notch is preferably formed in the second member. Alternately, at least one cue receiving notch is formed in the outer edges of each of the first and second members. Preferably, the first and second members have a substantially planar form with a plurality of angularly disposed side edges. The at least one notch is formed in at least one and preferably, in the case of a plurality of notches, in more than one of the side edges of each of the first and second members.

The first and second members are rotatably juxtaposed over the body with the first member disposed adjacent to an enlarged end of the body. The first and second members are independently rotatable about the body from a first overlapped storage position in which the side edges of the first and second members are aligned to at least one second use position in which the first and second members are angularly disposed with respect to each other and in which the at least one cue receiving notch of one of the first and second members is disposed on an upper edge of each of the first and second members.

A plurality of detents are formed on one of the first and second members, such as the first member. Detent engaging means are formed on the other of the first and second members, such as the second member, for releasably engaging the detents to define the first and second positions of the first and second members relative to each other.

In a particular advantageous embodiment of the present invention, a third member is also rotatably mounted on the body. The third member may also have a cue receiving notch formed therein. The third member is disposed adjacent to the second member on the body. A plurality of detents are also formed on the third member. The detent engaging means engages the detents in each of the first and third members to define the first and second positions of the first, second and third members relative to each other. Preferably, the detent engaging means includes first and second resilient arms which are carried on the second member. A detent engaging paw is formed at the end of each of the first and second arms. The detent engaging paws extend outward from opposite sides of the second member to respectively engage the detents in the first and third members.

Retaining means are employed to rotatably mount the first and second or the first, second and third members on the body of the bridge. Optionally, finger engaging surfaces may be formed on each of the member to facilitate rotation of each member between the first and second positions.

The adjustable cue bridge of the present invention performs the normal functions required of a cue bridge in that it is adjustable to a variety of different configurations to enable a cue stick to be supported at any desired position on a pool or billiards table. Uniquely, the adjustable cue bridge of the present invention is collapsible to a small compact size for easy storage, such as in the pocket of a player. At the same time, the adjustable cue bridge is easily deployable to the desired configuration for use.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
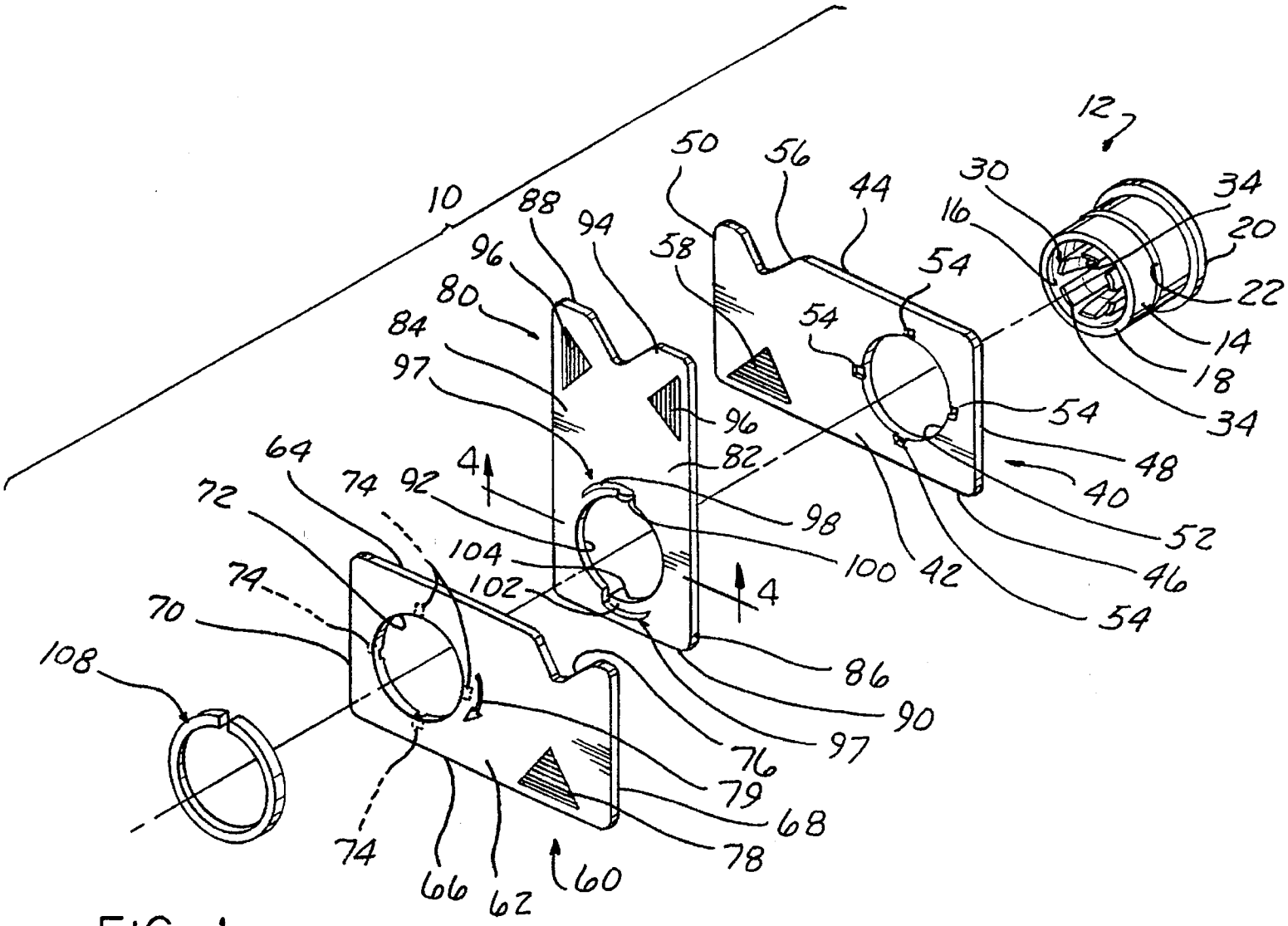
FIG. 1 is an exploded, perspective view of one embodiment of an adjustable cue bridge constructed in accordance with the teachings of the present invention.

Referring now to the drawing, and to FIGS. 1–6 in particular, there is depicted an adjustable cue bridge 10 which is useful in supporting the tip of a cue stick during the play of the game of pool or billiards. The cue bridge 10 includes a body 12 formed of a suitable material, such as an ABS plastic. The body 12 includes a generally cylindrical sleeve 14 having a bore 16 extending from an open first end 18 to a closed second end 20. The second end 20 is in the form of an enlarged diameter end flange having a diameter larger than the diameter of the sleeve 14.

An annular groove 22 is formed about the periphery of the sleeve 14 intermediate the first and second ends 18 and 20. Further, as shown in FIG. 3, a conical-shaped notch 24 is formed internally within the sleeve 14 and projects axially from the second end 20.

Receiver means 30 is carried within the sleeve 14 of the body 12. By example only, the receiver means 30 comprises a gripper member, preferably formed of a suitable plastic, such as nylon, having a base 32 and a plurality of circumferentially spaced, axially extending fingers 34. The exterior ends of the fingers 34 define an expandable opening which is sized to releasably, but securely receive and grip the tip end of an elongated member, such as the tip of a cue stick 36 as shown in FIG. 2, to mount the cue bridge 10 to the elongated member 36.

Figure 2:
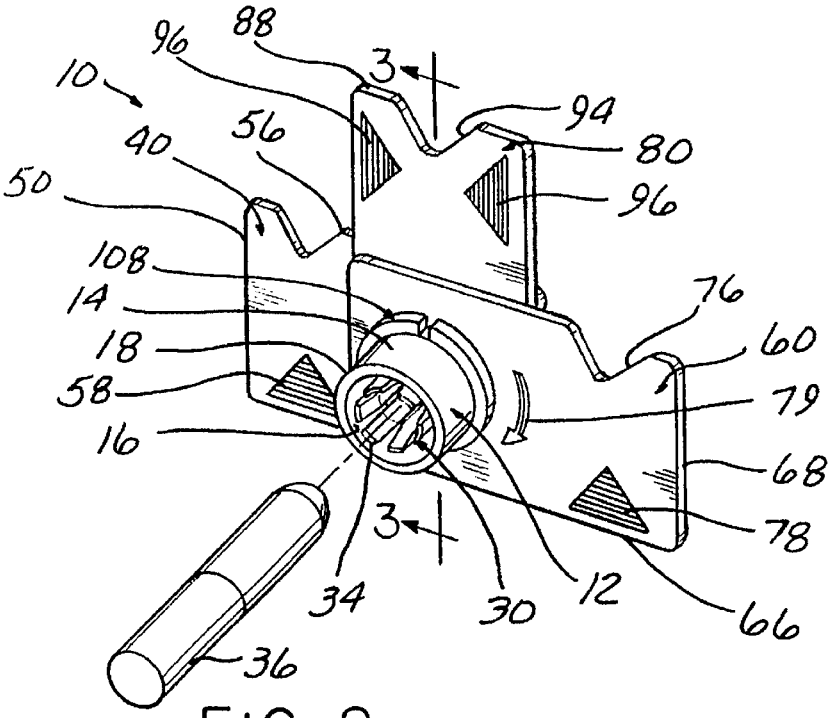
FIG. 2 is a perspective view of the adjustable cue bridge shown in FIG. 1, deployed in a first use position.
Figure 3:
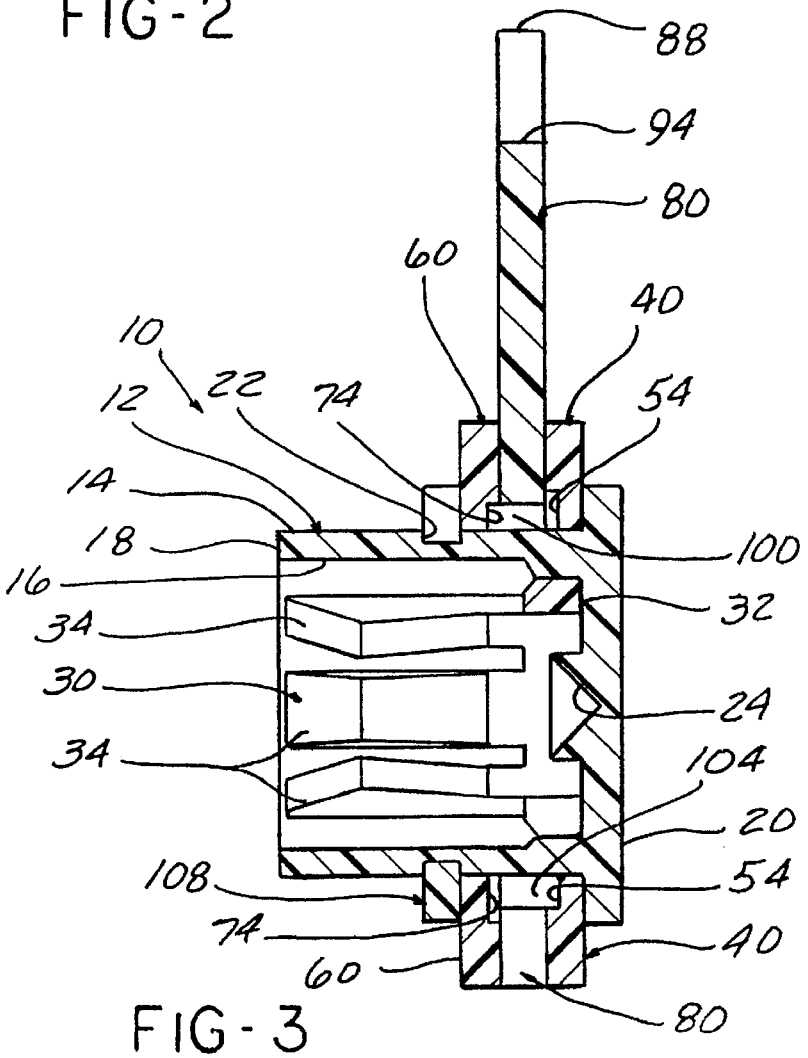
FIG. 3 is a cross sectional view generally taken along line 3—3 in FIG. 2.

As shown in FIGS. 1, 2 and 3, the adjustable cue bridge includes first and second members 40 and 80, respectively, each of which are independently rotatably mounted in a juxtaposed manner on the sleeve 14. The first member 40 is in the form of a planar plate 42 having any shape, such as polygonal, oval, etc. A rectangular shape, as shown in FIG. 1, is depicted by way of example only. The plate 42 is formed with first and second long side edges 44 and 46 and opposed, short side edges 48 and 50. A mounting aperture 52 is formed in the plate 42 generally offcenter and closer to one side edge 48 than the opposite side edge 50.

A plurality of detents 54 are formed in the plate 42 adjacent to the edges of the mounting aperture 52. The detents 54 are formed on one major surface of the plate 42 as shown in FIG. 1.

At least one cue supporting aperture or notch 56 having a V-shape is formed in the plate 52. By example only, the notch 56 is formed on the long side edge 44 in close proximity to, but spaced from the short side edge 50. Finger engagable surfaces 58, in the form of a plurality of raised ribs or projections, are formed on one and preferably both opposed major surfaces of the plate 42 to facilitate rotation of the first member 40 about the sleeve 14 as described hereafter.

In this embodiment, a second member 80 is disposed on the sleeve 14 adjacent to the first member 40 as shown in FIGS. 1–4. The second member 80 is formed similarly to the first member 40 and is in the form of a planar plate 82 having opposed long side edges 84 and 86 and opposed short side edges 88 and 90. A mounting aperture 92 is formed in the plate 82 generally closer to the short side edge 90. At least one cue receiving notch 94 is formed in the plate 82 preferably in the short side edge 88. Further, at least one and preferably a pair of finger engagable surfaces 96, generally in the form of raised ribs or projections, are formed on at least one and preferably both major surfaces of the plate 82 to facilitate rotation of the second member 80 as described hereafter.

Figure 4:
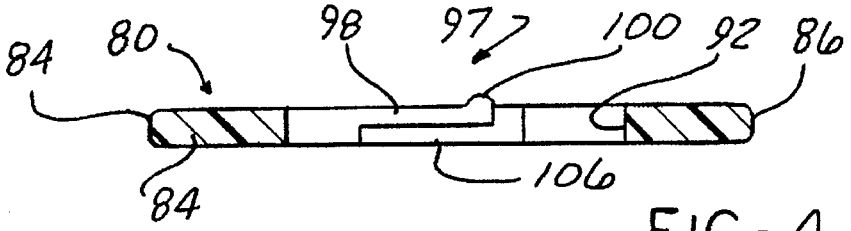
FIG. 4 is a cross sectional view generally taken along line 4—4 in FIG. 1.

Detent engaging means 97 are formed in the second member 80 as shown in FIGS. 1, 3 and 4. The detent engaging means 97 is preferably in the form of a pair of resilient, cantilevered arms, such as arms 98 and 102. Each arm 98 and 102 terminates in an enlarged end portion or paw, such as paw 100 on the arm 98 and paw 104 on the arm 102. The detent engaging paws 100 and 104 extend in opposite directions outward from opposed major surfaces of the second member 80 as shown for the arm 98 and detent engaging paw 100 in FIG. 4. In this orientation, the detent paw 100 is positioned to engage the detents 54 in the first member 40; while the opposed detent paw 104 on the arm 102 is positioned to releasably engage similar detents 74 in a third member 60, described hereafter.

As shown in FIG. 4, each detent engaging arm 98 has a tapered edge 106 to enhance the spring or resilient action of each detent engaging arm 98 and 102 to releasably engage the respective detent paw 100 and 104 in the detents 54 and 74 as the first, second and/or third members 40, 80 and 60 are rotated about the sleeve 14 with respect to each other as described in greater detail hereafter.

The third member 60 is preferably identically constructed to the first member 40 and includes a planar plate 62 having the same configuration as the first plate 40. The plate 62 has first and second opposed long side edges 64 and 66 which are interconnected by opposed short side edges 68 and 70. A mounting aperture 72 is formed in the plate 62 generally closer to the side edge 70. A plurality of detents 74 are formed in the plate 62 adjacent to the mounting aperture 72 on one major surface of the plate 62 as shown in FIGS. 1 and 3. At least one cue receiving notch 76 is formed in the plate 62, preferably in the long edge 64 and closer to the short side edge 68 than the opposed side edge 70. Finger engagable surfaces 78 are formed on each of the major surfaces of the plate 62 to facilitate rotation of the second member 60. Further, a directional turn arrow 80 is formed on one surface of the third member 60 to indicate the preferred direction of rotation of the third member 60 for movement of the third member between various deployed and storage positions, as described hereafter. A similar directional arrow 79 is formed on one surface of the first member 40.

It will be understood that although the first, second and third members 40, 80 and 60 are illustrated as having identical shapes, such as identical lengths between the respective short side edges and also identical widths between the longer edges, any of the length and/or width of any of the members 40, 80 and 60 may be made longer or shorter than the lengths or widths of the other members 40, 80 and 60.

Further, although one cue receiving notch 56, 94 and 76 is described as being formed in each member 40, 80 and 60, respectively, in a simple embodiment only one notch, such as notch 94 in the second member 80, for example, need be provided.

In addition, the notches 56, 76 and 94 may take other shapes, such as U-shaped open-end slots or closed apertures in each member 40, 80 and 60.

In assembling the adjustable cue bridge 10, the first member 40 is initially placed over the sleeve 14 by sliding the mounting aperture 52 of the first plate 40 over the sleeve 14 until one surface of the first member 40 is disposed adjacent to the enlarged end flange at the second end of the sleeve 14. In this position, the detents 54 on the first member 40 face axially away from the enlarged end flange on the body 12. The second member 80 is then mounted on the sleeve 14 by sliding the mounting aperture 92 over the sleeve 14 until one surface of the second member 80 is disposed adjacent to the first member 40. In this position, the detent paw 100 on the arm 98 on the second member 80 is positioned to engage one of the detents 54 in the first member 40. The third member 60 is then mounted on the sleeve 14 by sliding the mounting aperture 72 over the sleeve 14 until the third member 60 is disposed adjacent to the second member 80 as shown in FIG. 3. In this position, the detent paw 104 on the arm 102 on the second member 80 is positioned to selectively engage one of the detents 74 on the third member 60.

A retaining means 108 is then mounted over the sleeve 14 and into the recess 22 in the sleeve 14. The retaining means 108 is, by example, a C-clip having a slot allowing the opposed ends of the clip 108 to expand when mounted about the sleeve 14 and then resiliently retract toward each other when the retainer clip 108 engages the recess 22. The means 108 retains each of the first, second and third members 40, 80 and 60, respectively, on the sleeve 14 while allowing independent rotation of each of the first, second and third members 40, 80 and 60 about the sleeve 14.

Figure 5:
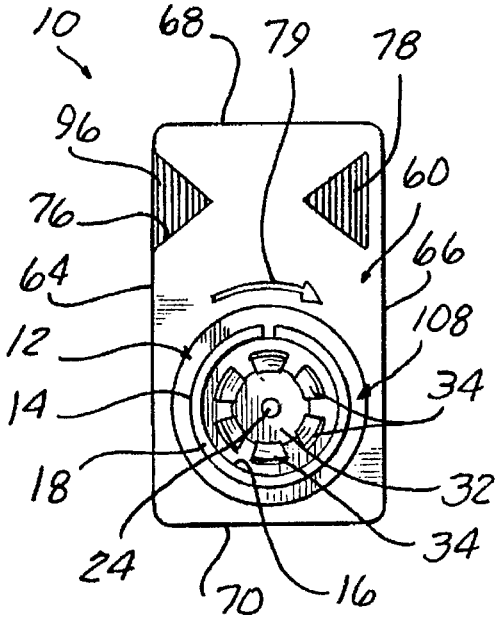
FIG. 5 is a front elevational view of the cue bridge depicted in a collapsed, storage position.

In use, the adjustable cue bridge 10 of the present invention may be reconfigured in any one of a number of different configurations depending upon the position of the cue ball and surrounding balls or table side rails to enable a player to support the cue stick at the desired position to strike a cue ball. FIG. 5 depicts a first storage position in which the first, second and third members 40, 80 and 60 are disposed in an overlapped arrangement with each of the long edges of each of the first, second and third members 40, 80 and 60 aligned with the long edges of the other first, second and third members 40, 80 and 60. This provides a small, compact size for the adjustable cue bridge 10 which makes it easy for a player to store the cue bridge 10 in a pocket between uses.

When it becomes necessary to use the cue bridge 10, the first, second and third members 40, 80 and 60 may be independently rotated about the sleeve 14 from the first storage position shown in FIG. 5 to various distinct positions via the detents 54 and 74. In one position shown in FIG. 2, the first and third members 40 and 60 extend laterally outward in opposite directions from the body 12 in a co-planar arrangement. During rotation of the first and third members 40 and 60, the detent engaging means 97 in the second member 80 releasably engages selected detents 54 and 74 in the first and third members 40 and 60, respectively, to releasably lock the first and third members 40 and 60 in the deployed position shown in FIG. 2.

In this position, the cue receiving notches 56 and 76 in the first and third members 40 and 60 are positioned at an upper portion of each of the first and third members 40 and 60 for use by the player. In addition, the second member 80 remains in its first position with the cue receiving notch 94 also disposed at an upper edge for selected use by a player. In addition, the lateral extension of the first and third members 40 and 60 provides a long support to securely support the adjustable cue bridge 10 on a pool or billiards table.

Figure 6:
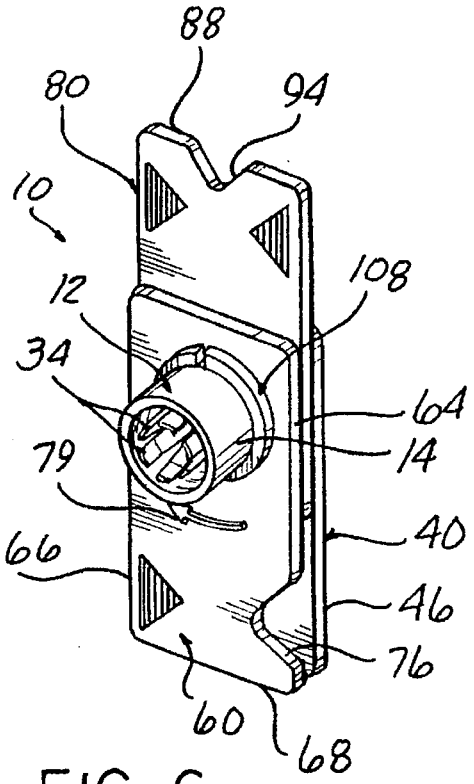
FIG. 6 is a perspective view of the cue bridge of the present invention wherein the rotatable members are reoriented into a configuration having an elongated height when the cue bridge is placed on a pool or billiards table.

FIG. 6 depicts an alternate configuration of the first, second and third members 40, 80 and 60 in which the overall length of the cue bridge 10, with respect to the edges of the cue bridge 10 which rest on the pool or billiards table, is elongated to raise the position of the cue receiving notch 94 in the second member 80 a greater distance above the pool or billiards table. To achieve this configuration, starting from the first storage position shown in FIG. 5, the first and third members 40 and 60 are rotated together 180° relative to the third member 80 from the first storage position shown in FIG. 5 to the configuration shown in FIG. 6.

It will also be understood that a plurality of cue receiving notches can be formed in each of the first, second and third members 40, 80 and 60. In addition, cue receiving notches may be formed in adjacent side edges of any or all of the first, second and third members 40, 80 and 60, in addition to the cue receiving notches 56, 76 and 94 shown in FIGS. 1 and 2.

Figure 7:
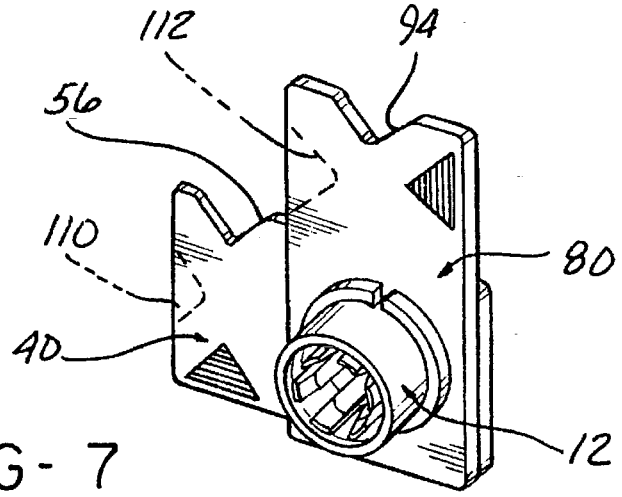
FIG. 7 is a perspective view of another embodiment of the adjustable cue bridge of the present invention shown in a first use configuration.

Turning now to FIG. 7, there is depicted an alternate embodiment of the adjustable cue bridge of the present invention in which the cue bridge 10 is formed of only two members, such as first member 40 and second member 80. This embodiment functions in the same manner as the embodiment shown in FIGS. 1–6 in that the first and second members 40 and 80 may be rotated from a first storage position to a second deployed position shown in FIG. 7. Only one cue receiving notch, such as notch 94 in second member 80, need be provided in this embodiment, although a notch in each member 40 and 80 is preferred. Additional cue receiving notches 110 and 112 may be respectively formed in side edges of the first and second members 40 and 80 for added versatility in utilizing the cue bridge 10 shown in FIG. 7. Detents 54 and detent engaging means 97 are formed in the first and second members 40 and 80 to define distinct rotatably disposed positions of the first and second members 40 and 80 with respect to each other.

Figure 8:
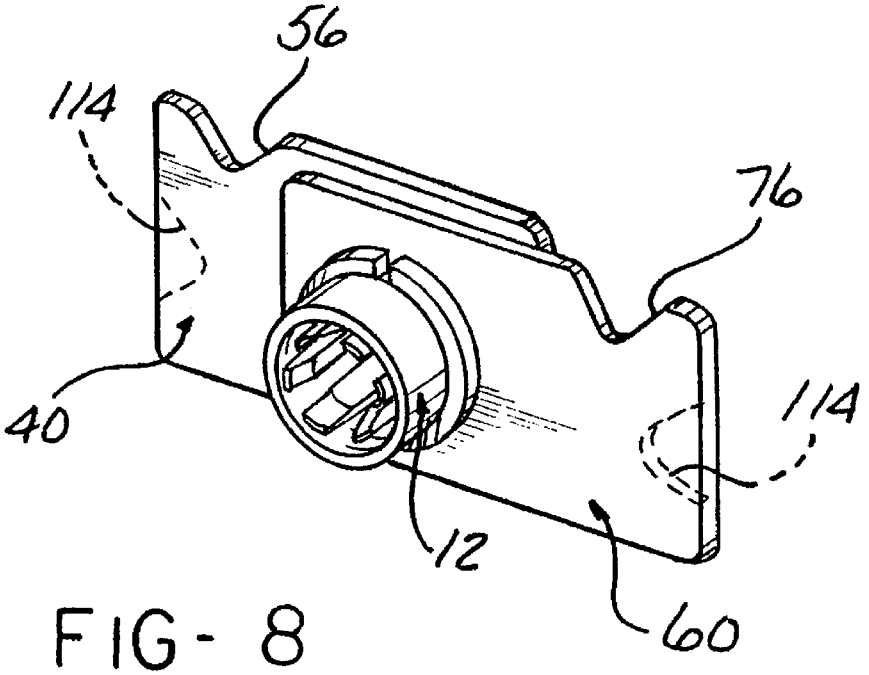
FIG. 8 is a perspective view of the cue bridge shown in FIG. 7, wherein the rotatable members are deployed in a second use position.

FIG. 8 depicts yet another embodiment of the cue bridge of the present invention which is formed of only the first and third members 40 and 60. Again, optional cue receiving notches 114 may be formed in either or both of the first and third members 40 and 60.

Figure 9:
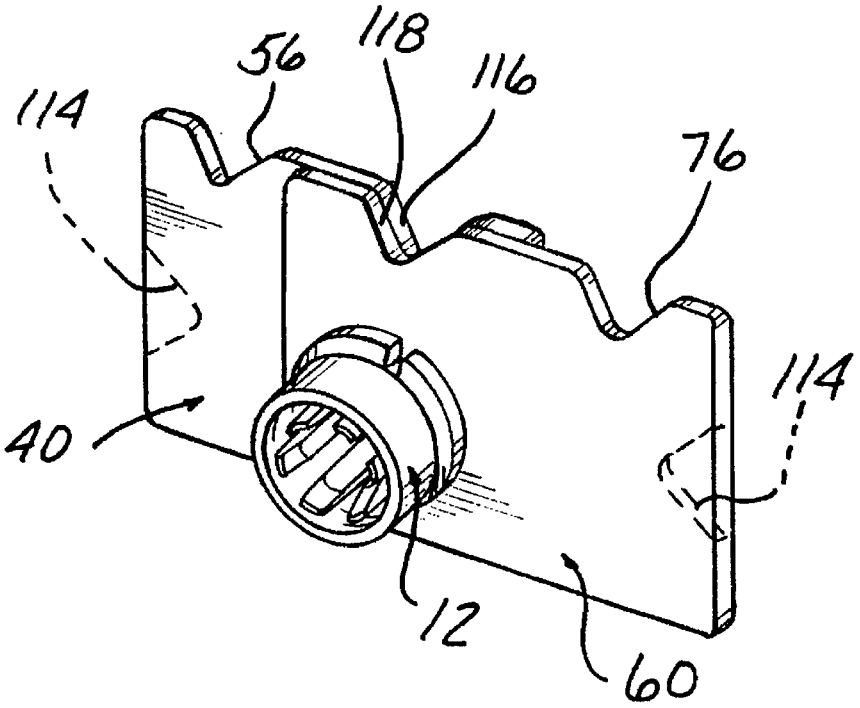
FIG. 9 is a perspective view of another embodiment of the adjustable cue bridge of the present invention.

Finally, another embodiment of the present cue bridge is shown in FIG. 9 which, in the same manner as the embodiments shown in FIGS. 7 and 8, is formed of only two members, such as first and third members 40 and 60. In this embodiment, an additional cue receiving notch 116 is formed in the first member 40 and an additional cue receiving notch 118 is formed in the third member 60 laterally spaced on the same long edge from the first cue receiving notches 56 and 76 in the first and third members 40 and 60, respectively. The additional cue receiving notches 116 and 118 are axially aligned when the first and third members 40 and 60 are deployed in the use position depicted in FIG. 9. This arrangement provides three laterally spaced cue receiving notches for selected use by a player.

In summary, there has been disclosed a unique adjustable cue bridge which is reconfigurable into a number of different configurations, one of which forms a small compact shape for easy storage between uses. The cue bridge may be reconfigured into one or more use configurations for versatility in playing pool or billiards.

What is claimed is:

1. A cue bridge mountable on a tubular member comprising:

a body;

receiver means, carried with the body, for receiving a tubular member;

first and second members, each rotatably carried on the body;

each of the first and second members having a planar configuration with a plurality of angularly disposed, peripheral side edges; and one cue receiving notch formed in each of at least two of the plurality of side edges of at least one of the first and second members.

2. The cue bridge of claim 1 wherein:

the first and second members are each independently rotatable about the body with respect to each other from a first overlapped storage position to a second use position in which the first and second members are angularly disposed with respect to each other.

3. A cue bridge mountable on a tubular member comprising:

a body;

receiver means, carried with the body, for receiving a tubular member;

first, second and third members, each rotatably carried on the body;

at least one of the first, second and third members having at least one cue receiving notch formed therein; and the first, second and third members each independently rotatable about the body with respect to each other from a first overlapped storage position to a second use position in which the first and third members extend oppositely outward from the body and the second member is angularly disposed to the first and third members.

4. The cue bridge of claim 3 wherein:

the second member is interposed between the first and third members on the body.

5. The cue bridge of claim 3 further comprising:

a plurality of detents formed on at least one of the first, second and third members; and detent engaging means formed on at least one of the other of the first, second and third members for engaging the detents to define the first and second positions of the first, second and third members relative to each other.

6. The cue bridge of claim 5 wherein the detent engaging means comprises:

first and second resilient arms; and a detent engaging paw formed at the end of each of the first and second arms, the detent engaging paw on the first arm extending outward from the other of the at least one of the first, second and third members in an opposite direction from the detent engaging paw on the second arm to respectively engage detents in the at least one of the first, second and third members, respectively, as at least one of the first, second and third members is rotated about the body.

7. The cue bridge of claim 3 further comprising:

finger engagable surface means, formed on at least one of the first, second and third members, for facilitating rotation of the first, second and third members relative to each other.

8. A cue bridge mountable on a tubular member comprising:

a body;

receiver means, carried with the body, for receiving a tubular member;

first and second members, each rotatably carried on the body, at least one of the members having at least one cue receiving notch formed therein;

the first and second members each independently rotatable about the body with respect to each other from a first overlapped storage position to a second use position in which the first and second members are angularly disposed with respect to each other;

a plurality of detents formed in one of the first and second members; and detent engaging means, formed on the other of the first and second members, for engaging the detents to define the first and second positions of the first and second members relative to each other.

9. The cue bridge of claim 8 wherein the detent engaging means comprises:

at least one resilient arm carried on the other one of the first and second members; and a detent engaging paw at the end of the arm and extending outward from the other one of the first and second members toward the one of the first and second members to engage the detents in the one of the first and second members as the first and second members are rotated relative to each other about the body.

10. The cue bridge of claim 8 further comprising:

finger engagable surface means formed on at least one of the first and second members, for facilitating rotation of the first and second members relative to each other.

11. A cue bridge mountable on a tubular member comprising:

a body;

receiver means, carried with the body, for receiving a tubular member; and a plurality of members, each rotatably carried on the body, at least one of the members having at least one cue receiving notch formed therein;

means for retaining the plurality of members on the body, the retaining means including:

an enlarged annular flange formed at one end of the body;

an annular groove formed on the body spaced from the enlarged end flange; and a retainer member mounted in the annular groove the plurality of members rotatably interposed between the annular flange and the retainer member.

12. The cue bridge of claim 11 wherein:

each of the plurality of members is rotatable between a plurality of distinct positions relative to the other of the plurality of members.

13. The cue bridge of claim 11 wherein:

each of the plurality of members has a planar configuration with at least one peripheral side edge.

14. The cue bridge of claim 13 wherein:

at least one cue receiving notch is formed in the at least one side edge of each of the plurality of members.

15. The cue bridge of claim 13 wherein:

each of the plurality of members is formed with a plurality of angularly disposed side edges.

16. A cue bridge mountable on a tubular member comprising:

a body;

receiver means, carried with the body, for receiving a tubular member; and a first member rotatably carried on the body and having at least one cue receiving notch formed therein;

a second member rotatably carried on the body and having at least one cue receiving notch formed therein;

a third member rotatably carried on the body and having at least one cue receiving notch formed therein, the second member interposed between the first and third members;

means for retaining the first, second and third members on the body;

a plurality of detents formed on the first and third members; and detent engaging means, formed on the second member, for engaging the detents in the first and third members to define a plurality of distinct positions for each of the first, second and third members relative to each other.

* * * * *